US008267071B2

(12) United States Patent
Janssen et al.

(10) Patent No.: US 8,267,071 B2
(45) Date of Patent: Sep. 18, 2012

(54) DEVICE FOR SEPARATING LIQUIDS FROM GASES

(75) Inventors: Hans Janssen, Dinklage (DE); Jorge Soares, Wettringen (DE); Tobias Burkert, Osnabrück (DE)

(73) Assignee: Polytec Automotive GmbH & Co. KG (DE)

( * ) Notice: Subject to any disclaimer, the term of this patent is extended or adjusted under 35 U.S.C. 154(b) by 526 days.

(21) Appl. No.: 12/374,903

(22) PCT Filed: Aug. 3, 2007

(86) PCT No.: PCT/EP2007/058085

§ 371 (c)(1),
(2), (4) Date: Feb. 6, 2009

(87) PCT Pub. No.: WO2008/019960

PCT Pub. Date: Feb. 21, 2008

(65) Prior Publication Data

US 2009/0241919 A1 Oct. 1, 2009

(30) Foreign Application Priority Data

Aug. 18, 2006 (DE) ..... 10 2006 038 700

(51) Int. Cl.
*F01M 13/04* (2006.01)
*B01D 45/12* (2006.01)

(52) U.S. Cl. ..... 123/572

(58) Field of Classification Search ..... 123/572–574, 123/41.86; 55/418–420, 459.1, 484
See application file for complete search history.

(56) References Cited

U.S. PATENT DOCUMENTS 5,460,147 A 10/1995 Bohl (Continued)

FOREIGN PATENT DOCUMENTS

DE 42 18 851 A1 12/1993

(Continued)

OTHER PUBLICATIONS

Bastias, P, et al., Olnebelabscheidung in der Kurbelgehauseentluftung auf engstem Raum.IN: MTZ-Motortechnische Zeitschrift, Jg. 66, H. 12, 2005, ISSN 0024-8525, pp. 966-971; Bild 1 u. tab 2.

(Continued)

*Primary Examiner* — M. McMahon

(74) *Attorney, Agent, or Firm* — Clements Bernared PLLC; Gregory N. Clements

(57) ABSTRACT

The invention relates to a device for separating liquids from gases, especially for separating oil particles from blow-by gases of the crankcase ventilation of internal combustion engines.

Proceeding from the drawbacks of the known prior art, a device is to be provided that is characterized by a simple, cost-effective and space-saving construction and with which a high separation performance can be achieved. As a solution, it is proposed that the individual flow tubes 2 have at least one tangentially arranged gas inlet 3 at their end facing towards the direction of gas inlet and are closed at the front side 2*a* adjacent thereto by means of a cover 5, wherein a combined rotational and axial flow with a vortex component is generated in the flow tubes 2, wherein the rotational flow in the individual tubes 2 repeatedly rotates by 360°.

The individual flow tubes 2 are part of a base support that has a circumferential edge 1*a*. A base support has, for example, from 30 to 40 flow tubes 2 that are immediately adjacent to one another or are arranged in the form of groups. The flow tubes 2 have an inner diameter D of, for example, 5 mm and a length of from 10 to 20 mm.

Due to the tangential introduction, the gas flow reaches higher rotational frequencies, and greater centrifugal forces are produced, whereby a clearly improved separating performance is achieved. The device may be designed as a very small and effective component that requires only a small installation space.

15 Claims, 4 Drawing Sheets

U.S. PATENT DOCUMENTS

| | | | | |
|---|---|---|---|---|
| 5,944,001 | A * | 8/1999 | Hutchins | 123/572 |
| 7,842,115 | B2 * | 11/2010 | Brand et al. | 55/459.1 |
| 2003/0024512 | A1 * | 2/2003 | Kitano et al. | 123/572 |
| 2003/0221398 | A1 | 12/2003 | Trautmann et al. | |
| 2006/0112941 | A1 * | 6/2006 | Hilpert et al. | 123/573 |

FOREIGN PATENT DOCUMENTS

| | | | |
|---|---|---|---|
| DE | 199 51 312 | A1 | 5/2001 |
| DE | 102 05 981 | A1 | 8/2003 |
| DE | 103 25 005 | A1 | 12/2004 |
| DE | 10 2004 006 082 | A1 | 8/2005 |
| DE | 10 2004 019 154 | A1 | 11/2005 |
| DE | 20 2004 010 550 | U1 | 12/2005 |
| DE | 10 2004 037 157 | A1 | 3/2006 |
| DE | 10 2005 038 257 | A1 | 2/2007 |
| EP | 1 312 879 | A1 | 5/2003 |
| EP | 1 500 423 | A1 | 7/2004 |
| NL | 8602941 | A | 6/1988 |

OTHER PUBLICATIONS

Meinig, U. et al, Kurbelgehause-Entlufung aktueller und zukunftiger Fahrzeugmotoren—Teil 1: Aktuelle Entlufgungssyste. In: MTZ-Motortechnische Zeitschrift, jg.65, H, 10, 2004, ISSN 0024-8525, pp. 768-777, Bild 4.

Meinig, U. et al, Kurbelgenhause-Entluftung aktueller und zukunftiger Fahrzeugmotoren-Teil 2:Neue Konzepte.ln: MTZ-Motortechnische Zeitschrift, Jg. 65, H. 11, 2004, ISSN 0024-8525, pp. 910-915; Bilder 5, 6.

Mann-Hummel Gruppe: IAA: Effizientere Olabscheidung durch Schalttechnologie.[recherchiert am Oct. 8, 2006]. Im Internet: <URL:www.mann-hummel.com/company/index.html>.

* cited by examiner

DEVICE FOR SEPARATING LIQUIDS FROM GASES

The invention relates to a device for separating liquids from gases, especially for separating oil particles from blow-by gases of the crankcase ventilation of internal combustion engines.

For deoiling crankcase ventilation gases, for example, cyclone separators of various constructions as single or multiple cyclones are known. The gas collecting in the crankcase that is loaded with oil droplets is introduced tangentially into the cyclone. Due to the centrifugal forces acting in the cyclone, the oil contained in the gas stream is deposited on the inner wall of the cyclone and supplied to the crankcase or oil sump of the internal combustion engine through an exit provided in the bottom portion of the cyclone. The gas stream is deflected in the cyclone, flows off as a pure gas through an immersion tube arranged at the head of the cyclone and arrives in the intake manifold of the engine. A single cyclone separator has a limited working range which results in insufficient separation when the flow rates are too low and in a high pressure loss when the flow rates are too high. To eliminate these drawbacks, the use of multicyclones arranged in parallel has been proposed (DE 10 2004 019 154 A1). The working range of multicyclones arranged in parallel can be additionally extended by switching into use and shutting off individual cyclones by means of a valve. Such multicyclones are designed, for example, as an independent assembly and occupy a relatively large installation space, because a spatial separation of the components raw gas, separated oil and pure gas is required.

Advantageously, oil separators are integrated in the valve cover of the internal combustion engine as disclosed, for example, in DE 10 2004 019 154 A1.

The integration of cyclone separators in a valve cover inevitably increases the complexity thereof and requires a relatively large installation space.

Also known are tubular rotary separators, which are reached by the flow predominantly from an axial direction. The rotational movement is caused by guide vanes arranged at the gas inlet.

From DE 10 2004 037 157 A1, such a liquid separator device for separating liquid or liquid mist from a gas is known in which helical guide segments extending over almost the entire length of the tubes are provided instead of guide vanes. This multiple tubular separator consists of at least one plate-type base support on which at least one liquid separator element is arranged. The latter consists of a flow tube with a gas inlet and a gas outlet. Between them in the flow tube, a helical segment is provided whose helical surfaces form a helical flow path with the inner wall of the tube. The helical segment has a length of less than a half turn of the pitch. For oil separation, several base supports with several separator elements may be arranged, wherein the senses of rotation can be the same or opposite in one flow path. As stated in the Example, the separator device can be provided in a hollow space of the valve cover behind a labyrinth-type coarse separator.

The blow-by gas, which enters the flow tubes from an axial direction, is set into rotational movement by the helical segments, wherein the oil is slung off the gas, deposited on the inner wall of the flow tubes, transported to the outlet of the flow tubes by means of the gas stream, and drained into a siphon. The helical segments arranged in the tubular separators or flow tubes produce a rotational flow in which the particles to be separated are subjected to a turn of only 180° when flowing through a segment. When two segments are arranged in succession, the flow runs in the opposite direction of rotation from the second segment. Following the helical segments, the rotating gas flow is moved in axial direction.

When the flow tubes are reached by the flow from an axial direction, the pitch of the vortex is greater, which results in a lower rotation rate, lower centrifugal forces, a smaller number of revolutions and thus lower degrees of separation. It is the object of the invention to provide a device for separating liquids from gases, especially for separating oil particles from blow-by gases of the crankcase ventilation of internal combustion engines, which is characterized by a simple, cost-effective and space-saving construction and with which a high separation performance can be achieved.

According to the invention, this object is achieved by the features stated in claim 1. Claims 2 to 14 relate to advantageous embodiments and further developments.

The flow tubes arranged in the plate-type base support have at least one tangentially arranged gas inlet at their end facing towards the direction of gas inlet. At the adjacent front side, the flow tubes are closed. Since every flow tube forms a separator element or tubular separator, they are in parallel connection. Since the gas stream, which is distributed to the individual flow tubes, is introduced therein exclusively from a tangential direction, a course of flow is established that results in an improvement of the separation performance as compared to the known tube separators reached by the flow from an axial direction. The tangential flow generates a combined rotational and axial flow with a vortex component in the flow tubes, wherein the rotational flow in the flow tubes repeatedly rotates by 360°. The number of rotations depends on the dimension of the gas inlet, the velocity of the gas flow and the length of the flow tubes, and several revolutions of the gas flow (5 to 10 revolutions) can be achieved. When the gas enters the tangential inlet, a flow is formed whose cross-section corresponds to the cross-section of the inlet and which is continued along the tube wall to the tube outlet. The kinetic energy produced by the flow rate of the gas and the tangential introduction can be utilized for the major part thereof for separating the particles dispersed in the gas stream. The flow path is not influenced by any additional forced flow, such as when helical segments are employed.

The gas flow reaches higher rotational frequencies, and greater centrifugal forces are produced. This results in a clearly improved separation performance. The liquid particles deposited on the inner wall of the flow tubes are dragged along in the flow direction and drop off at the gas outlet of the flow tubes by gravity, collect at the bottom of the installation space and are discharged therefrom through a discharge opening.

Another advantage is the very simple structure of the device. In addition, the device may be designed as a very small effective unit that requires only a small installation space. In addition, different possible combinations that enable adaptation to different operation conditions can be obtained without greater constructional changes.

The tangential gas inlets of the flow tubes can have a slot-shaped or gap-shaped design. The individual flow tubes may also have several gas inlets, which preferably have a radially offset arrangement. The gas inlets may also have cross-sectional areas of different sizes. By the above mentioned measures, the flow rate within the flow tubes can be influenced.

The individual flow tubes preferably have an inner diameter of from 2 to 20 mm and a length that is at least twice the inner diameter of the flow tubes. Depending on the available installation space and the dimension of the flow tubes, more than 100 flow tubes, preferably from 30 to 50 flow tubes, can be arranged in a base support. The flow tubes may extend beyond the plate-type base support in one direction, i.e., be flush with the frame of the base support or extend beyond the base support on both sides. The base support may also be embodied as a wall segment of a housing or installation space. The outer shape of the base support may be different, for example, rectangular, circular or oval, and be adapted to the respective installation conditions.

Preferably, the flow tubes should be flush with one another at the gas inlet side. In this case, the face-sided openings on the gas inlet side can be closed by means of a cover plate. Otherwise, the individual flow tubes can be designed already during the preparation thereof in such a way that they have no face-sided opening on the gas inlet side.

On their gas outlet sides, individual or even all flow tubes can be equipped with a valve that will open in a pressure-dependent way. Depending on the applied pressure difference or flow rate, individual tube separators are automatically switched into use or shut off again. Thus, the working range of the separator device can be extended due to the small dependence of the degree of separation on the flow rate. The extension of the optimum working range can be advantageously utilized, in particular, for deoiling crankcase ventilation gases since the gas flow rate may vary over more than one power of ten depending on the working condition of the internal combustion engine. As the valves, per se known simple and inexpensive spring valves may be employed. Each of the spring valves has a sealing surface which closes off at least one or more flow tubes on the gas outlet side. The spring valves close off the gas outlet side under the action of a bias. Through the bias, the pressure difference at which the valve will open can be set. In addition, the use of several spring valves with different biases enables a staged switching into use of further tube separators, so that the control of the separator can be adapted even more precisely to the respectively prevailing working conditions.

The plate-type base support may be equipped with flow tubes except for a circumferential edge zone.

If several flow tubes are arranged on a base support, it is to be taken care that the tangential inlets are not occluded by adjacent flow tubes. Groups of adjacent flow tubes of the same length and flush face sides can have, among others, circular or star-shaped arrangements or be arranged in double rows with inlets facing outward. For three or more neighboring rows, the occlusion of the inlets can be avoided by having axially displaced rows or flow tubes with different lengths.

The separation device, which acts as a parallel connection in principle, may also be extended as a combined series connection by arranging several plate-type base supports with flow tubes at a mutual distance. The distance between the individual base supports must be at least so large that the droplets exiting from the flow tubes can sink down in the direction of gravity and are not dragged along by the gas stream into the gas inlets of the flow tubes of the subsequent base support. For example, the distance between the base supports is from 10 to 20 mm. By the above mentioned series connection, an embodiment for a staged coarse and fine separation can be realized.

A base support which is to be employed for the separation of larger particles or drops (coarse separator) is advantageously equipped with flow tubes that have an increased tangential inlet cross-section and a larger inner diameter. Coarse separators have a higher intake capacity for larger particles, but do not separate the smaller particles due to the smaller centrifugal forces. These are then separated in the downstream base support for fine separation whose flow tubes have smaller diameters and smaller entry cross-sections. A preliminary separation can prevent overload of the fine separator. In an embodiment with a coarse separator and downstream fine separator, a separate liquid drain is assigned to every base support or separator.

If a vertical arrangement or installation position of the plate-type base supports is required for reasons of application technology, the flow tubes can be designed with an inclination towards the liquid collection site. A better draining of the separated liquid particles is achieved thereby. As an alternative, the plate-type base supports may also be arranged in an inclined position in the installation space. The flow tubes have an inclined downward position in this way, so that the liquid separated in the flow tubes can readily drain towards the liquid collection site.

A single or several plate-type base supports are arranged in a housing or installation space. The housing or installation space have a raw gas inlet, a pure gas outlet and a liquid outlet and thus form a separation unit. In a per se known manner, a space provided in the valve cover is used as an installation space in the separation of oil from blow-by gases of internal combustion engines. Valve covers are preferably designed as plastic injection-molded parts. The proposed separation device is particularly suitable for this purpose, both as a fine separator and as a combined coarse and fine separator, because of its space-saving construction and its low weight. The plate-type base supports with the flow tubes are also prepared from plastic and can be designed by injection molding in one molding process in combination with a component of the valve cover as one integral component.

In this case, the port for supplying the blow-by gas, the pure gas outlet and the oil outlet are also integral parts of the valve cover. Alternatively, it is also possible to secure the plate-type base supports in its installation position in the housing or installation space by sliding into corresponding grooves, welding, screwing, bonding or clipping.

According to another variant embodiment, several separation units may also form a functional unit in which the individual separation units are connected in parallel. A "separation unit" means a housing or installation space with a gas inlet, at least one base support with flow tubes, pure gas outlet and liquid outlet. The respective gas inlets of the individual separation units may be separately switchable into use depending on the prevailing gas flow rate by corresponding valves incorporated in the manifold conduits for the supplied gas flow rate. This embodiment is of advantage when relatively large and varying gas flow rates are obtained.

The invention will be further illustrated in the following by means of some Examples.

Figure 1:
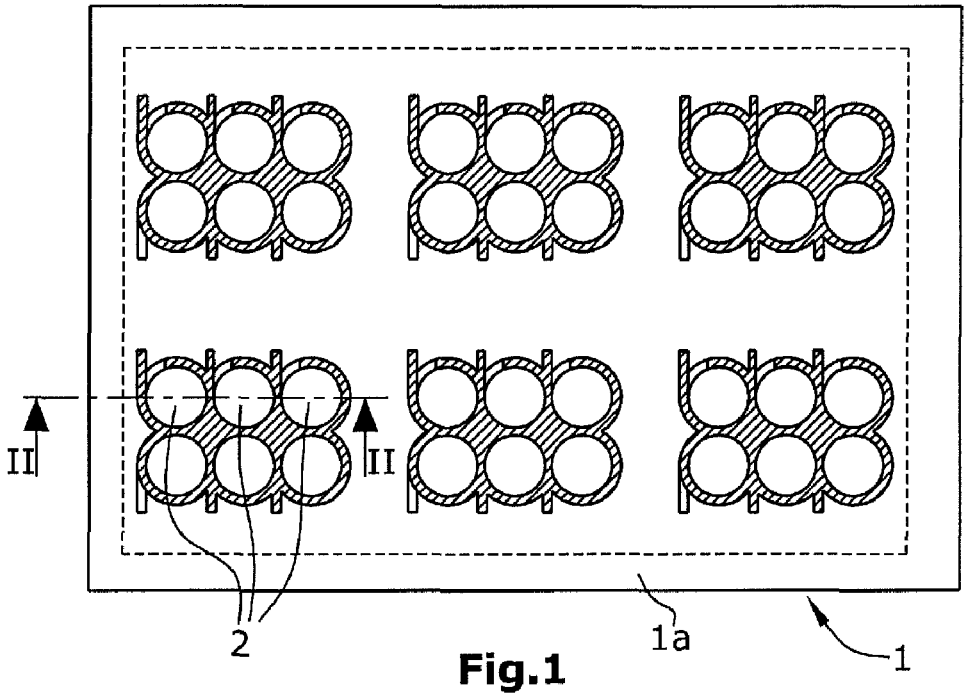
FIG. 1 shows a top plan view of a single base support with several flow tubes arranged in groups.

The base support 1 shown in FIG. 1 is designed as a plate-type plastic component with a large number of small integrally molded flow tubes 2. The plate-type base support 1 has a circumferential edge 1*a*. A base support 1 has, for example, from 30 to 40 flow tubes 2 that are immediately adjacent to one another or are arranged in the form of groups. The flow tubes 2 have an inner diameter D of, for example, 5 mm and a length of from 10 to 20 mm. In the Example shown in FIG. 1, six groups with six flow tubes 2 each are provided.

Figure 2:
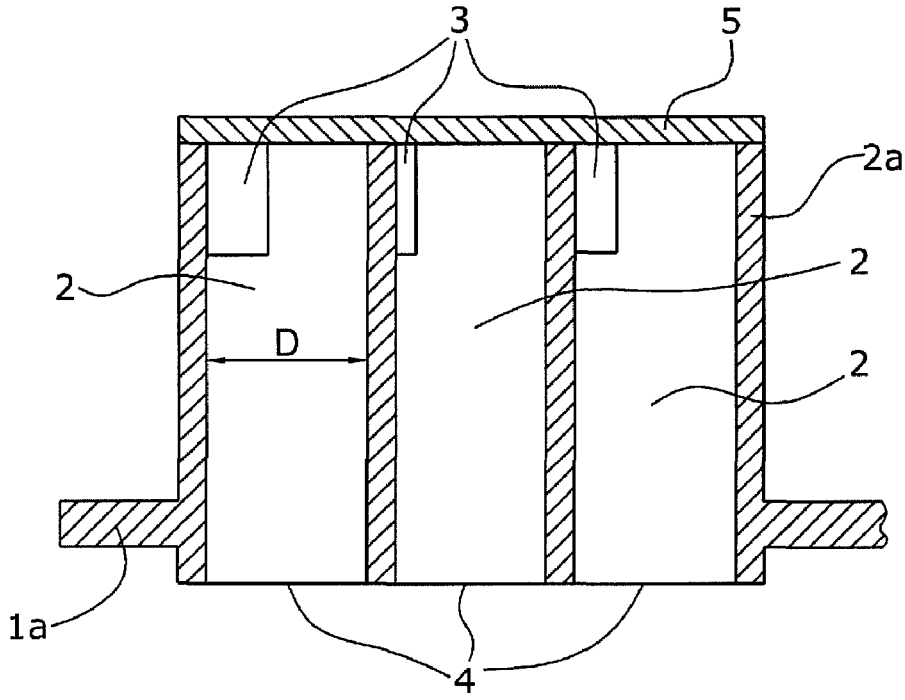
FIG. 2 shows a section along the line A-A in FIG. 1.

FIG. 2 shows a section with a group of six flow tubes 2. The individual flow tubes 2 have a tangential raw gas inlet 3 and a gas outlet 4 through which the pure gas and separated liquid exit. The gas outlets 4 are almost in a plane with the base support 1. The individual flow tubes 2 of the same length are closed at their end facing towards the direction of gas inlet, at the front side 2*a*, by means of a cover plate 5, which is attached in the example shown. If the base support 1 is prepared from plastic, the cover plate 5 may also be integrally molded to the respective groups and overlap the flow tubes 2 of each group. On the section of the flow tubes 2 facing towards the direction of gas inlet, the tangential gas inlet 3 is respectively arranged, for example, as a gap or slot. In the individual flow tubes 2 reached by the flow from a tangential direction, a combined rotational and axial flow is produced with a vortex component, the rotational flow repeatedly rotating by 360°.

Several tangential gas inlets in a radially offset arrangement may also be provided instead of one tangential gas inlet 3. In the example shown, the tangential gas inlets 3 of the individual flow tubes 2 have identical designs and have cross-sectional areas of entry of the same size. The cross-sectional areas of entry may also have different sizes.

Figure 3:
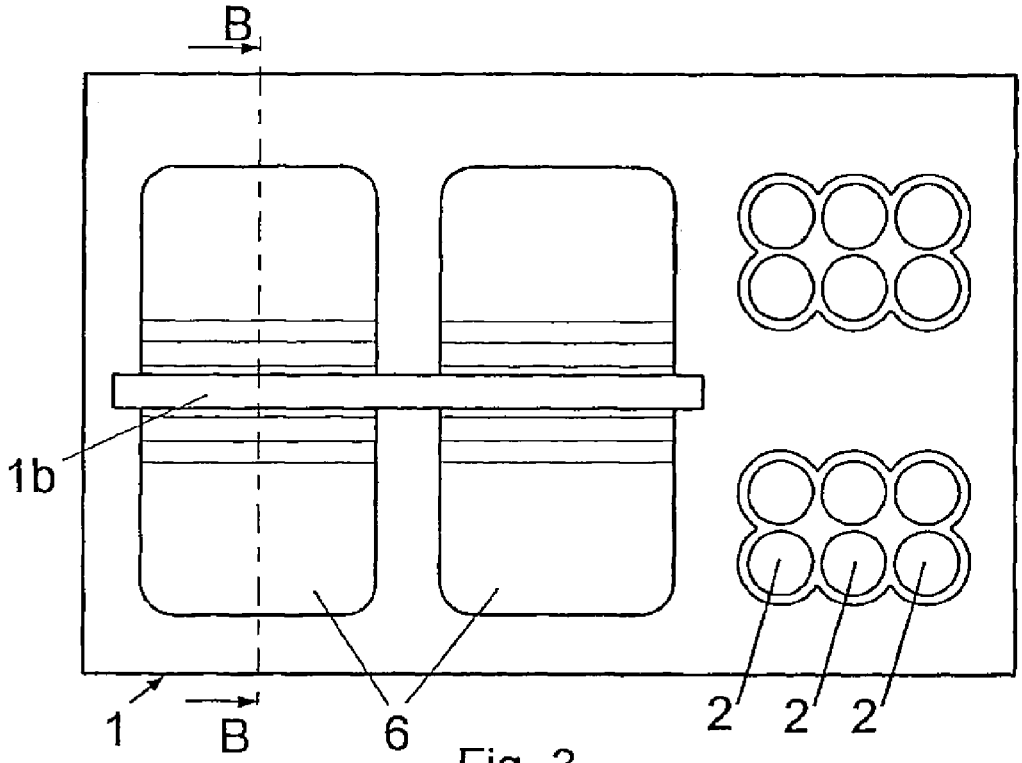
FIG. 3 shows a top plan view of a base support in which the gas outlets of several groups of flow tubes can be closed with a spring valve.
Figure 4:
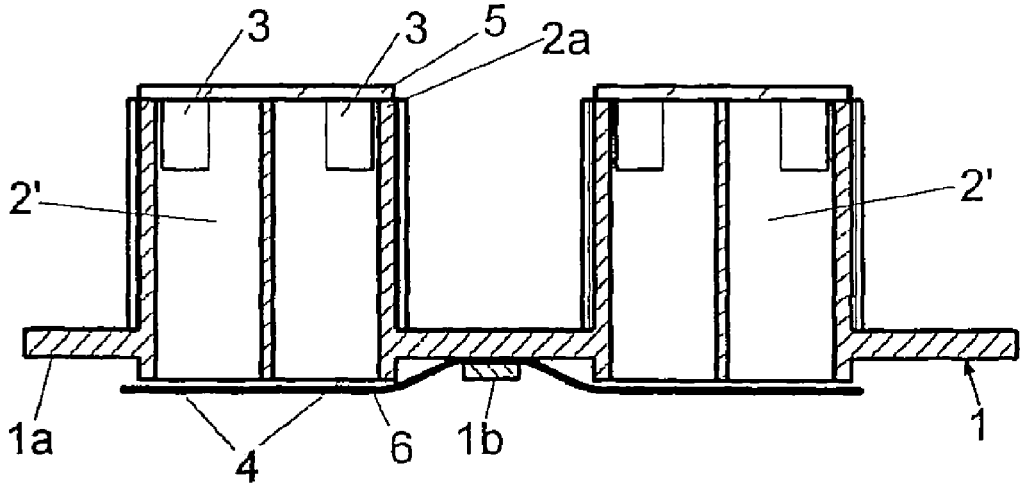
FIG. 4 shows a section along the line B-B in FIG. 3.

FIGS. 3 and 4 show a variant embodiment in which the base support 1 has six groups with six flow tubes 2 each. The gas outlets 4 of the flow tubes 2' of four neighboring groups can be closed by means of a spring valve 6. The spring valves 6 designed in the form of a bending spring are secured to the base support through an attachment part 1*b* and have a sealing surface that closes the gas outlets 4 of the flow tubes 2'. The differential pressure at which the valve opens can be set through the bias on the spring valves 6. As can be seen in FIG. 3, the gas outlets 4 of two groups of flow tubes 2 have no valve and are thus constantly open. The individual flow tubes serving the function of a separator element are thus better adaptable to the respectively prevailing working conditions.

Figure 5:
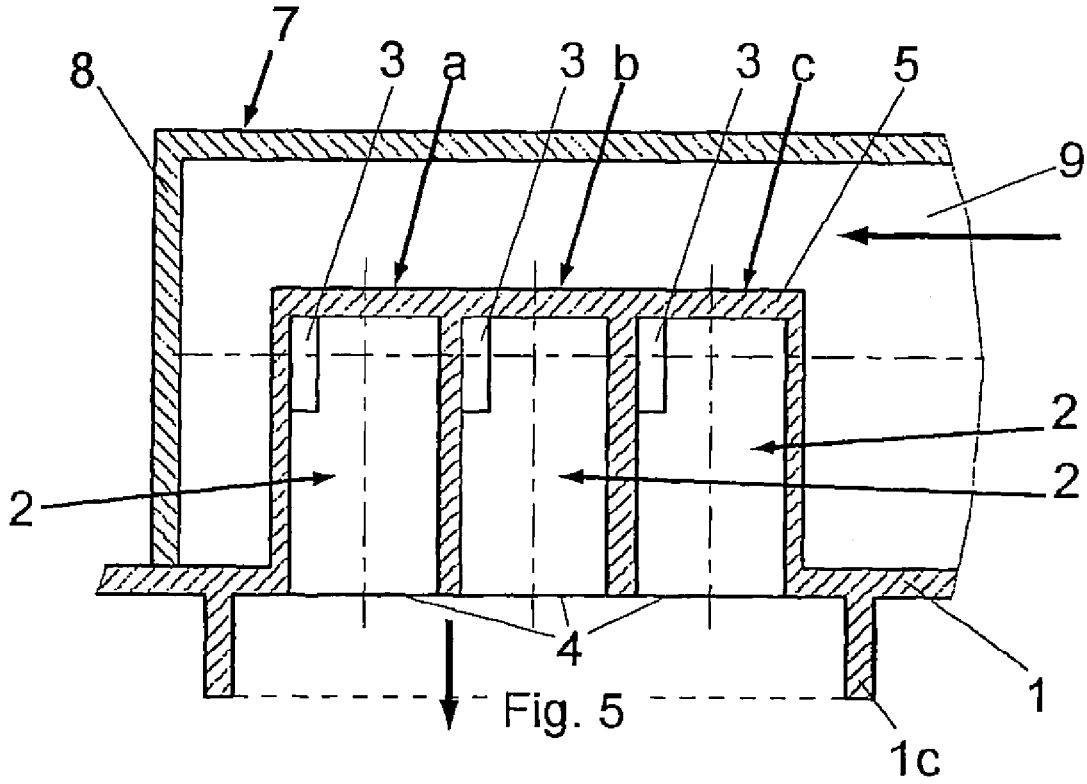
FIG. 5 shows the arrangement of a base support in the installation space of a valve cover in longitudinal section.

FIG. 5 shows a variant embodiment in which the base support 1 is integrated with the flow tubes 2 in the installation space of a valve cover 7. Of the valve cover, only the segment that forms the immediate installation space bounded by the wall segments 8 can be seen. In FIG. 5, the narrow side of the installation space can be seen into which the base support 1 is inserted in a horizontal installation position and welded to the downward protruding ends of the wall segments 8. The base support 1 has three rows a, b, c each with 10 adjacent flow tubes 2, wherein only the front flow tubes 2 can be seen in FIG. 5. The individual flow tubes 2 have an analogous design to that of the embodiment shown in FIGS. 1 and 2. The cover plate 5 on the gas inlet side of the flow tubes 2 is integrally molded with them. On its bottom side, the base support 1 has a circumferential segment 1*c* in fluid communication with the adjacent space for discharging the pure gas and receiving the dripped-off oil that is indicated by a downward pointing arrow in FIG. 5.

The arrangement of the base support 1 in the installation space forms a raw gas space 9 above the flow tubes 2. The direction of flow of the raw gas is indicated by an arrow. The raw gas stream flowing laterally into the valve cover 7 is uniformly distributed to the thirty vertically arranged flow tubes 2 and is introduced therein tangentially through the gas inlets 3. Within the flow tubes 2, a helical flow forms that repeatedly rotates by 360°, wherein the oil contained in the raw gas is deposited on the inner wall of the flow tubes 2 due to the high centrifugal forces acting thereon, and dragged away in a vertical direction of flow. The pure gas also flows off downward in a vertical direction as indicated by the arrow shown in FIG. 5.

Figure 6:
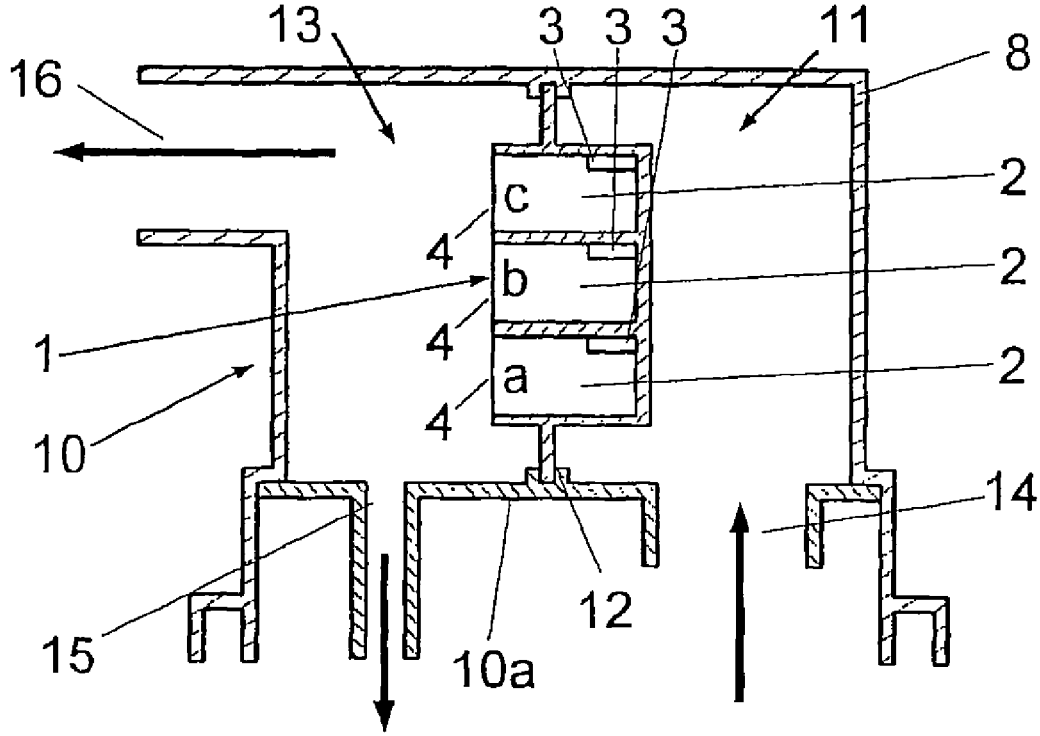
FIG. 6 shows the arrangement of a base support in a housing as a separation unit in longitudinal section.

FIG. 6 shows the arrangement of a base support 1 in a housing 10 wherein the base support 1 is inserted in groove-like recesses 12 of the housing 10 in a vertical installation position. The individual flow tubes 2 of the base support 1 are horizontally arranged. By the arrangement of the base support 1, the housing 10 is subdivided into a raw gas space 11 and a pure gas space 13. In the bottom portion 10*a* of the housing 10, an opening 14 for supplying the raw gas and an outlet 15 for the liquid separated in the flow tubes 2 and collecting at the bottom portion is provided. The pure gas outlet 16 is on the upper portion of the housing 10. The directions of flow for the raw gas and pure gas and the direction of drain of the separated liquid are indicated by arrows. The base support 1 has 3 rows a, b, c each with 10 congruently arranged flow tubes 2. In the raw gas chamber 11, the raw gas flowing from below through the opening 14 is uniformly distributed to the thirty horizontally arranged flow tubes 2 and is introduced therein tangentially through the gas inlets 3. The mode of action of the liquid separation is analogous to the above described embodiment. The liquid deposited on the inner wall of the flow tubes 2 is dragged away in a horizontal direction of flow and drips off down-wards at the gas outlet 4 of the flow tubes 2. The purified gas stream flows off through the pure gas outlet 16. The liquid collecting at the bottom portion 10*a* is discharged through the drain 15.

Figure 7:
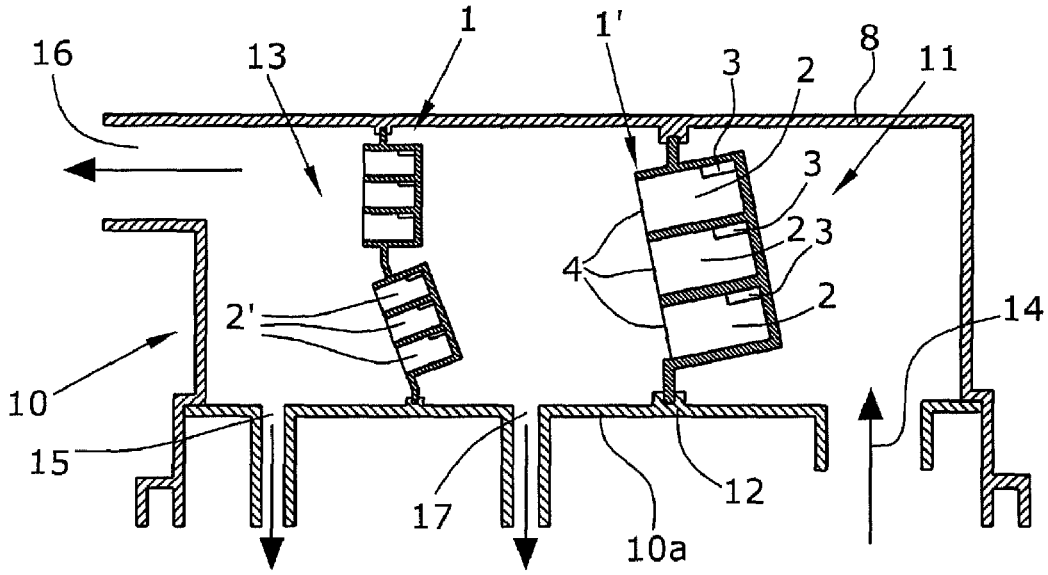
FIG. 7 shows a variant embodiment for coarse and fine separation in longitudinal section.

The housing 10 shown in FIG. 6 with the base support 1 forms an independent separator unit. In special cases of application, it may also be convenient to arrange several of these separator units in rows or in parallel connection. Several base supports, which preferably have different designs in terms of their separating performance may also be arranged in one housing or installation space instead of a single base support 1. FIG. 7 shows two spaced-apart base supports 1 and 1', wherein base support 1' is designated for coarse separation, and base support 1 for fine separation. The flow tubes 2 of the coarse separator 1' have a larger inner diameter than that of the flow tubes 2 of the downstream fine separator 1. In addition, another liquid drain 17 is provided between the two base supports. The structure of the housing 8 is otherwise analogous to that in FIG. 6. Such an arrangement is a combination of parallel and series connections, wherein the flow tubes of a base support are in parallel connection, and several base supports are in series connection. This very simple and space-saving structure of such a separator unit can be employed, in particular, for combined coarse and fine separation.

The invention claimed is:

1. A device for separating oil particles from blow-by gases of a crankcase ventilation of internal combustion engines, consisting of a source of crankcase ventilation, at least one plate-type base support having several flow tubes, tops of the flow tubes are completely closed off by a cover plate, a tangentially arranged gas/liquid inlet at an upper side of each of the tubes, and a gas/liquid outlet at a bottom opening of each of the flow tubes, wherein the liquid will deposit on the inner wall of the flow tubes, and the gas is centrally surrounded by said liquid as they are discharged from said gas/liquid outlet, wherein a combined rotational and axial flow with a vortex component is generated in the flow tubes, wherein the rotational flow in the individual tubes repeatedly rotates by 360° .

2. The device according to claim 1, characterized in that the gas inlets have a slot-shaped or gap-shaped design.

3. The device according to claim 1, characterized in that the individual flow tubes (2, 2') have several gas inlets (3) having a radially offset arrangement.

4. The device according to claim 1, characterized in that the gas inlets have different cross-sectional areas.

5. The device according to claim 1, characterized in that the individual flow tubes have an inner diameter of from 2 to 20 mm.

6. The device according to claim 1, characterized in that the length (L) of the flow tubes is at least twice the inner diameter (D) thereof.

7. The device according to claim 1, characterized in that the flow tubes arranged in a base support are flush with one another at their gas inlet side.

8. The device according to claim 1, characterized in that some of the flow tubes (2') are equipped with a valve (6) at their gas outlet side (4) that opens in a pressure-dependent way.

9. The device according to claim 1, characterized in that the individual flow tubes have different diameters and lengths.

10. The device according to claim 1, characterized in that several plate-type base supports (1, 1') with flow tubes (2, 2') are arranged at a mutual distance in series connection.

11. The device according to claim 1, characterized in that when the plate-type base supports are arranged in a vertical installation position, the flow tubes are arranged with an inclination towards a liquid collection site.

12. The device according to claim 1, characterized in that a single or several plate-type base supports are arranged in one housing or installation space that has a raw gas inlet a pure gas outlet and a liquid outlet and forms an independent separator unit.

13. The device according to claim 1, characterized in that the plate-type base supports in said housing or installation space are secured in their installation position by sliding into corresponding grooves, welding, screwing, bonding or clipping.

14. The device according to claim 1, characterized in that several separator units connected in parallel are provided, wherein the gas inlets) of the individual separator units are separately switchable into use depending on the prevailing gas flow rate.

15. The device according to claim 1, wherein the gas/liquid inlet of the individual flow tubes are positioned towards the source of crankcase ventilation.

* * * * *